United States Patent [19]

Burkstaller

[11] Patent Number: 4,881,846

[45] Date of Patent: Nov. 21, 1989

[54] BUILT-UP PLAYING COURT STRUCTURE AND METHOD FOR ITS CONSTRUCTION

[75] Inventor: Herman F. Burkstaller, Box 67, Nogal, N. Mex. 88341 Emmet F. Brieger, Bonito Route Nogal, New Mexico 88341

[73] Assignee: Herman F. Burkstaller, Nogal, N. Mex.

[21] Appl. No.: 174,118

[22] Filed: Mar. 28, 1988

[51] Int. Cl.[4] ..... A01G 25/00; E02B 11/00

[52] U.S. Cl. ..... 405/37; 405/38; 405/50

[58] Field of Search ..... 405/36, 37, 38, 43, 405/50, 51

[56] References Cited

U.S. PATENT DOCUMENTS

| | | | |
|---|---|---|---|
| 585,856 | 7/1897 | Swanson . | |
| 1,222,648 | 4/1917 | Marks . | |
| 1,690,020 | 10/1928 | Kirschbraun . | |
| 1,862,423 | 6/1932 | Otto . | |
| 1,958,850 | 5/1934 | Foster | 94/7 |
| 2,024,158 | 12/1935 | Gallagher | 94/7 |
| 2,931,146 | 2/1936 | Dodge | 47/38 |
| 3,307,360 | 3/1967 | Bailly | 405/38 |
| 3,908,385 | 9/1975 | Daniel et al. | 61/11 |
| 4,044,179 | 8/1977 | Haas, Jr. | 428/17 |
| 4,576,511 | 3/1986 | Vidal | 405/37 |

FOREIGN PATENT DOCUMENTS

| | | | |
|---|---|---|---|
| 111978 | 9/1964 | Czechoslovakia | 405/38 |
| 2727956 | 1/1979 | Fed. Rep. of Germany | 405/38 |
| 482615 | 7/1953 | Italy | 405/38 |

OTHER PUBLICATIONS

*Tennis Courts 1984–1985,* published for the United States Tennis Association, p. 31 (1984).

*Primary Examiner*—David H. Corbin

*Attorney, Agent, or Firm*—Deborah A. Peacock; Robert W. Weig

[57] ABSTRACT

The disclosure relates to a built-up playing court structure having a stable moisture content controlled surface layer with playing qualities equivalent to conventional clay courts. The playing court structure comprises a built-up court surface layer, a barrier surface which is substantially impervious to moisture, a containment wall, a subsurface bed of aggregate, and means for controlling the moisture content of the court surface. A subsurface moisturizing and drainage system provides a horizontal playing surface, highly resistant to any washing away of surface materials. Controlling surface moisture also provides a consistent playing surface with no loss of surface materials due to wind.

27 Claims, 4 Drawing Sheets

BUILT-UP PLAYING COURT STRUCTURE AND METHOD FOR ITS CONSTRUCTION

FIELD OF THE INVENTION

The present invention relates to a built-up playing court structure, enabling a selected moisture content to be maintained within its surface layer, and a method for its construction.

DESCRIPTION OF THE PRIOR ART

There are at present two basic types of surfaces used for playing courts, "hard" surfaces and "soft" surfaces. Hard surface courts generally have concrete and asphalt surfaces and, indoors, wood surfaces. Soft surface courts generally have lawn, clay and various composite built up surfaces. To effectively play court games, one is required to repeatedly turn and move with rapidity. One of the primary disadvantages of the use of hard surface courts is that the bones, muscles and connective tissues of players are stressed by repetitive activity on the hard surface. Conventional soft surface courts however, also have disadvantages. Construction and maintenance costs are typically very high. Frequent cutting, rolling, smoothing and replenishing of the surface materials is required to keep the surface in a playable condition. Additionally, since most of these soft surface courts are constructed outdoors, and are porous, water retention following ambient rainfall may preclude play on the court surface due to puddles or a general muddy court surface having a slippery consistency.

Built-up playing courts consisting of gravel, sand, clay and various bonding materials have been developed in the art as a more practical alternative to conventional clay courts. A clay or sand top surface layer is desirable, because such a layer makes a surface more playable by providing smoothness yet appropriate traction for the soles of players' shoes. However, there are several problems inherent in such conventional built-up surfaces. Loose sand or clay which is normally present at the uppermost surface layer over time, washes down through the lower layer materials, such as gravel, due to rain or sprinkling; this sand or clay is thus lost from the surface and has to be periodically replaced. Drainage of such courts presents a problem because the sand or clay tends to fill all of the void spaces between the lower surface materials (e.g. gravel). Thus, water will not drain laterally below the surface at a sufficiently fast rate. Hence, water drainage usually runs off over the top surface, gradually removing the surface materials. Even if the surface materials are not washed away, they tend to be redistributed unevenly, causing smoothing problems. Furthermore, unless the surface is adequately sloped and almost perfectly uniform, there will be standing puddles of water following rains which will preclude use of the court until the water is removed by evaporation. Almost all conventional soft surface and hard surface courts have a slope in an attempt to prevent puddling. Another problem occurs in cold weather areas. Water trapped within the void spaces below the surface freezes. The expansion that takes place during freezing causes movement of the surface, thereby damaging it. Repair is necessary to smooth the damaged areas. Another problem is that wind tends to blow away or unevenly rearrange surface materials, especially when the surface is dry; again, requiring replacement or smoothing. This problem could be alleviated considerably by sprinkling the surface with water. However, during periods of winds or play, sprinkling is impractical. Another problem with wind is that the top surface tends to dry out, resulting in poor footing for the players and inconsistent ball bounce.

Since court games, particularly tennis, are played by millions of people, much time and energy has been devoted to solving such problems inherent in maintaining outdoor athletic courts. Examples of proposed solutions to some of the problems are disclosed in U.S. Pat. Nos. 585,856, entitled Underground Irrigation, to Swanson; 1,222,648, entitled Growing Trough, to Marks; 1,690,020, entitled Pavement, and Process of Laying Same, to Kirschbraun; 1,862,423, entitled Playing Court, to Otto; 1,95,8,850 entitled Tennis Court, to Foster; 2,024 158, entitled Playing Court, to Gallagher; 2,031,146, entitled Automatic Watering Device, to Dodge; 3,908,385, entitled Planted Surface Conditioning System, to Daniel et al.; and 4,044,179, entitled Playing Surface for Athletic Games, to Haas, Jr. None of these patents teach a court surface structure having a built-up court surface layer and means for selectively controlling moisture content in the built-up court surface layer. These patents are discussed in more detail below.

The '856, '648 and '146 patents disclose subsurface irrigation devices. The irrigation systems are used for providing water to a vegetative surface cover.

The '020, '158 and '179 patents disclose permanent, fixed surfaces. The '020 patent is directed to a combined bituminous and concrete pavement surface. The '158 patent teaches a playing court surface atop cork/sand gravel beds. The '179 patent discloses an artificial turf fabric surface which is intended to simulate grass.

The '385 patent discloses a system for irrigating and evacuating a playing field having a vegetative cover. This system incorporates a lattice of perforated pipes under the playing surface. The pipes are covered by a layer of sand followed by a layer of rooting media on which the vegetative matter is grown. A pump attached to the pipe lattice allows a vacuum to be applied and accumulated surface water to be drawn down within the subsurface sand layer. Also incorporated into the system is a moisture sensor which allows automatic irrigation of the field.

The '423 patent discloses a soft surface court having a pervious surface layer which enhances drainage and moisture retention, depending upon ambient conditions. The '850 patent teaches the use of fine epidote as a top layer and coarser epidote as a lower layer for a tennis court surface. Neither of these patents provide means for moisturizing the surface.

SUMMARY OF THE INVENTION

The present invention relates to a built-up, moisture content controlling playing court structure comprising a built-up court surface layer, a barrier surface substantially impervious to moisture spaced beneath the built-up court surface layer, a containment wall positioned essentially peripherally about the built-up court surface layer and the barrier surface and extending upwardly from the barrier surface to about the level of the built-up court surface layer disposed thereabove, a subsurface bed of aggregate disposed atop the barrier surface and beneath the built-up court surface layer, the aggregate bed being peripherally surrounded by the containment wall, and means for controllably introducing liquid to and draining liquid from the subsurface bed of aggregate and the built-up court surface layer to substantially maintain a selected moisture content in the built-up court surface layer. Moisture content in the surface layer is controlled by maintaining an appropriate liquid level in the subsurface bed, thereby providing upward movement of moisture by capillary action or wicking to the top surface layer. The moisturizing rate, which can be controlled to be essentially equal to the evaporation rate, is determined by the liquid level and the particle sizes in the subsurface bed.

The subsurface bed of aggregate preferably comprises materials of at least two distinct size ranges to provide both adequate support for the built-up court surface layer and sufficient liquid conductivity for upward capillary movement and downward and lateral draining to substantially maintain the selected moisture content in the built-up court surface layer. The two distinct materials can be sand and gravel. If sand is used, it is preferably common builders sand having a size of between approximately 0.005 and about 0.025 inch in average cross-sectional width. If gravel is used, it preferably has an average cross-sectional width of between approximately 0.5 and approximately 1 inch. Other materials, such as fine-grain clay and brick dust can also be used in accordance with the invention.

The built-up court surface layer is preferably essentially horizontal. This compares with conventional court surfaces which must be sloped in an attempt to prevent puddling.

The subsurface bed of aggregate can also comprise a layer of somewhat adhesive material applied atop the subsurface bed of aggregate to assist in maintaining the supportive stability of the subsurface bed of aggregate. The layer of adhesive material comprises voids therein to provide adequate liquid conductivity between the subsurface bed of aggregate and the built-up court surface layer thereabove to substantially maintain the selected moisture content in the built-up court surface layer. The somewhat adhesive material should be essentially moisture impervious. The somewhat adhesive material is preferably polyurethane, epoxy, rubberized asphalt, or a mixture thereof.

The barrier surface can be a plastic sheet or an existing hard court surface that is sufficiently waterproof. The containment wall is preferably between approximately 4 inches and 6 inches high.

The liquid to be introduced to the subsurface bed of aggregate and the built-up court surface may comprise water alone or water containing antifreeze, herbicide, surfactant, wetting agent, detergent, or a mixture thereof.

The structure for introducing liquid to and draining liquid from the subsurface bed of aggregate and the built-up court surface layer preferably comprises a plurality of generally horizontally positioned pipes disposed above the barrier surface, the pipes comprising apertures for introducing liquid to an draining liquid from the subsurface bed of aggregate, thereby controlling moisture content in the built-up court surface layer.

Furthermore, liquid flow into and drainage from the pipes is controllable to substantially maintain the selected moisture content of the built-up surface layer. Control can be manually, by a float valve, a moisture sensor, or other such device, available in the art.

Preferably, the pipe apertures are covered with screening to deter aggregate material from entering and depleting the surface sand layer. Preferably, the pipes are disposed at an angle to the horizontal sufficient to provide satisfactory liquid flow therethrough from the force of gravity. The pipes can be disposed within the subsurface bed of aggregate having an average size which is larger than the apertures, with a layer of screening disposed above the subsurface bed of aggregate to deter aggregate material from entering the pipes. In this situation, the invention further preferably comprises a second subsurface bed of aggregate disposed above the screening, having an average cross-sectional width which is smaller than the average cross-sectional width of the aggregate in the subsurface bed disposed beneath the screening.

In an alternative embodiment, means for introducing liquid to and draining liquid from the subsurface bed of aggregate and thereby the built-up court surface layer comprise at least one fill-drain pipe having an opening in the subsurface bed of aggregate. The opening of this fill-drain pipe is preferably covered with screening to deter aggregate material from entering the fill-drain pipe. In this embodiment, drain and fill pipes within the bed are not necessary because the pore spaces among the pieces of gravel below the screen provide adequately for liquid flow.

The invention further comprises a method of constructing a built-up, moisture content controlling playing court structure comprising the following steps:

(a) obtaining a foundation for the playing court;
(b) providing a moisture barrier above the foundation;
(c) providing a containment wall peripherally about the foundation;
(d) positioning above the moisture barrier means for introducing liquid to and draining liquid from the playing court structure to substantially maintain a selected moisture content in the playing court structure;
(e) providing a subsurface bed of coarse aggregate above the moisture barrier; and
(f) introducing fine aggregate into the voids of the coarse aggregate and on to its surface to provide a built-up, moisture content controlling playing court structure.

The foundation can also comprise a hard-surface playing court or compacted dirt.

A primary object of the present invention is to regulate the moisture content in the surface of a soft-surface athletic playing court.

Another object of the invention is to provide a playing surface of consistent quality.

A further object of the present invention is to provide a built-up surface playing court which is inexpensive to construct and maintain.

One advantage of this invention is that in accordance therewith, surface runoff during rain can be greatly reduced to essentially eliminate washing away and puddling of the surface.

Another advantage of the invention is that wind erosion is substantially reduced by providing moisture to the court surface at all times, including windy periods.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawings, which are incorporated into and form a part of the specification, illustrate several embodiments of the present invention and, together with the description, serve to explain the principles of the invention.

DETAILED DESCRIPTION OF THE INVENTION

Figure 1:
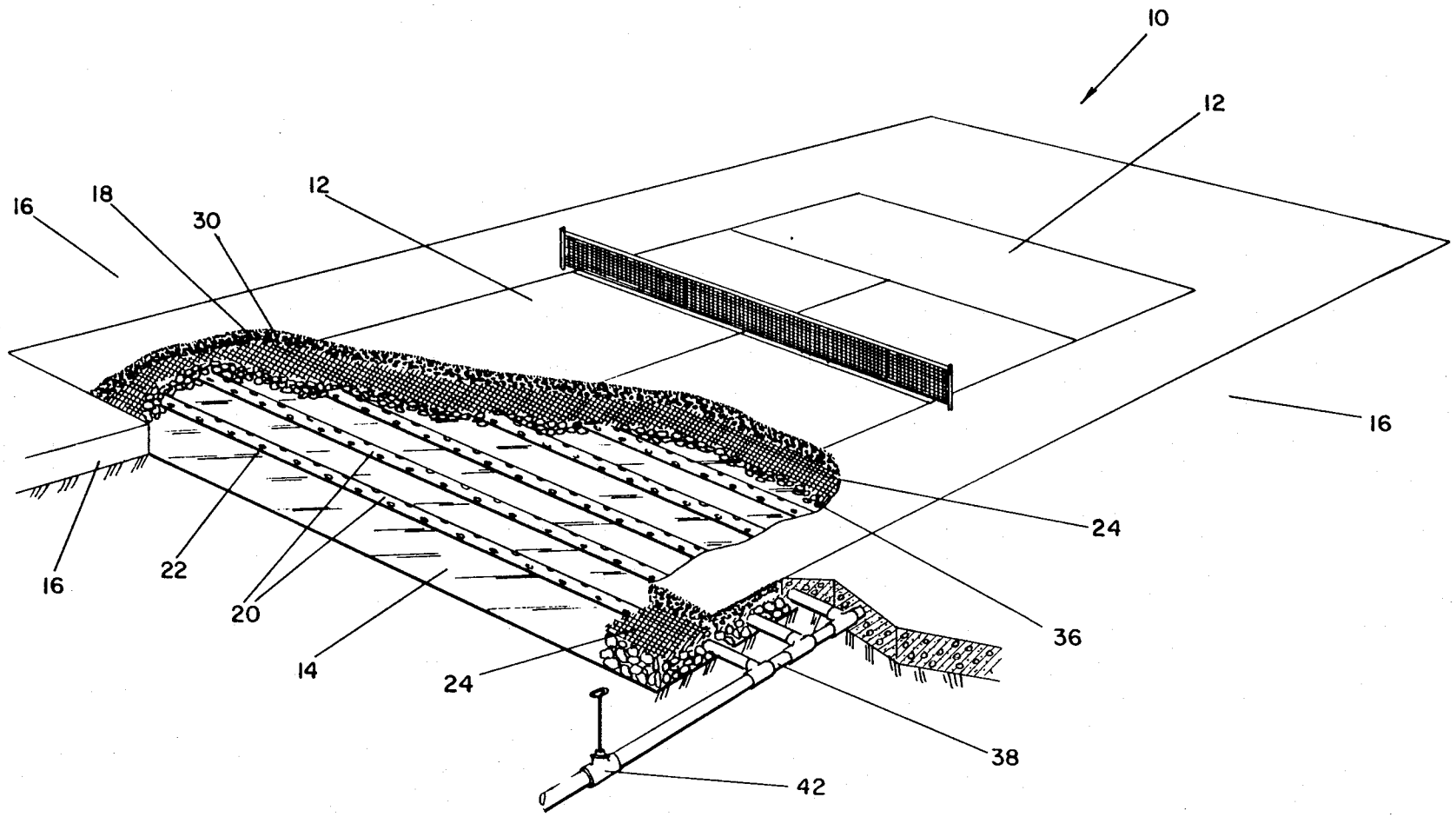
FIG. 1 is an isometric view of the built-up playing court structure of the invention.

The present invention relates to a built-up playing court structure having a system for controlling the moisture content of the playing surface and the court structure. The invention can be utilized in the construction of new playing courts or to convert or retrofit existing playing courts. FIG. 1 shows a built-up playing court structure 10 in accordance with the present invention comprising a built-up court surface layer 12, a moisture barrier 14 spaced beneath the built-up court surface layer 12, a containment wall 16 on the periphery of the court 10, a subsurface bed 18 of aggregate material, and pipes 20 for controlling the moisture content in the subsurface bed of aggregate 18 and thereby surface layer 12.

Figure 2:
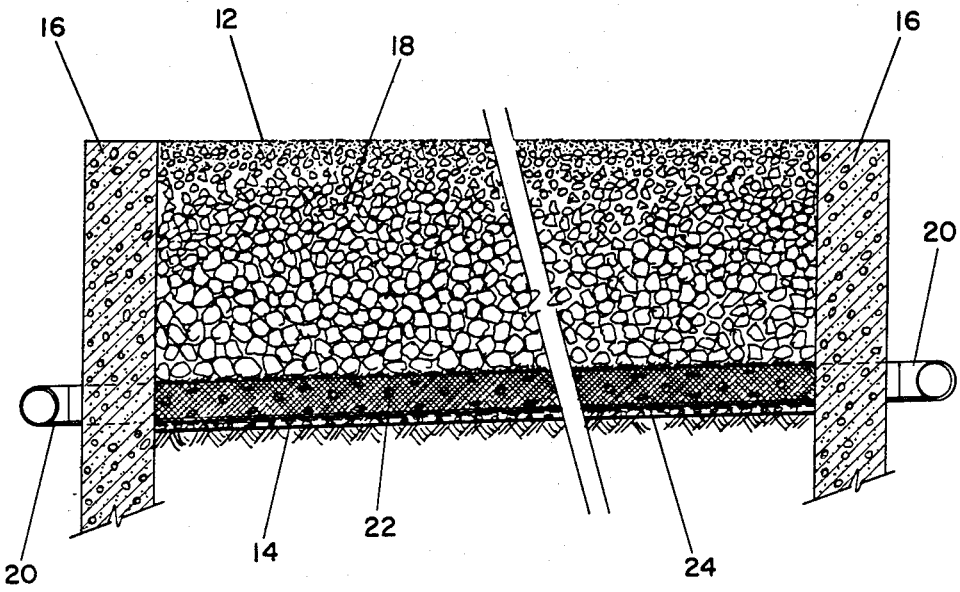
FIG. 2 is a side view of one of the built-up court structure embodiments of the invention.

Pipes 20 contains perforations or apertures 22 for introducing liquid to and draining liquid from the subsurface bed of aggregate 18 and, therethrough, the built-up court surface layer 12 The pipes 20 of a preferred embodiment, disposed generally horizontal, are substantially parallel to one another and spaced three to six feet apart. Pipes 20 can be disposed directly above the moisture barrier 14, or within the subsurface bed of aggregate 18. Although generally horizontal, the pipes 20 preferably slope slightly to enhance drainage, as shown in FIG. 2; but they can be disposed horizontally. If the pipes 20 slope slightly, moisture barrier surface 14 can also slope, as shown in FIG. 2. An existing hard court surface, which is converted to a built-up court in accordance with the invention, would most likely have such a slope. Whether or not the barrier surface 14 is sloped, the built-up court surface layer 12 can be horizontal because of the moisture content controlling capability of the invention which ensures proper drainage and moisturizing of the surface layer 12. This surface layer 12 preferably has a thickness above the gravel of between approximately ⅛ inch and ⅜ inch. In contrast, prior art playing surfaces are usually built having a slight slope in order to prevent puddling. Moisture barrier 14 can comprise, for example, a compacted surface covered with a waterproof membrane, such as a plastic sheet, or the surface of an existing hard court, preferably waterproofed or covered with a waterproof material.

For moisturizing the surface of the playing court in accordance with the invention, the moisture content of the built-up court structure 10 is controlled by introducing liquid into the pipes 20 liquid which flows out of the apertures 22 into the playing court structure 10. For drainage, liquid passes from the playing court structure 10 through the apertures 22 and pipes 20. As mentioned previously, it is desirable to maintain a selected moisture content within the built-up court surface layer 12. The surface 12 should be kept somewhat moist, but not wet, to provide good footing, ball bounce, smoothness and firmness. Court surface 12 is also kept moist to eliminate dust during play and to eliminate the problem of wind depleting and redistributing the surface sand.

Although fresh, potable water will usually be the liquid used in accordance with the invention, other liquids may be utilized. For example, salt water or other non-potable water sources which may be available can also be utilized. Additionally, when temperatures are below the freezing point, antifreeze can be introduced into the pipes 20 to prevent the liquid in voids 30 between the pieces of aggregate material 18 from freezing and expanding, thereby causing damage to the court. Herbicides can also be added to the liquid to reduce or eliminate undesired vegetative growth on the built-up court surface. Likewise, surfactants, wetting agents, detergents, and other additives may be added to the liquid to enhance the movement of moisture upward by capilliarity from the liquid level within the pipes 20 to the surface layer 12.

The pipes 20 may be made of any suitable metal or plastic, or any other type of material usable in subsurface applications. The preferred pipe size is between approximately 1.5 inches and 2.5 inches outside diameter; however, other sizes can be utilized in accordance with the invention, as desired.

Figure 4:
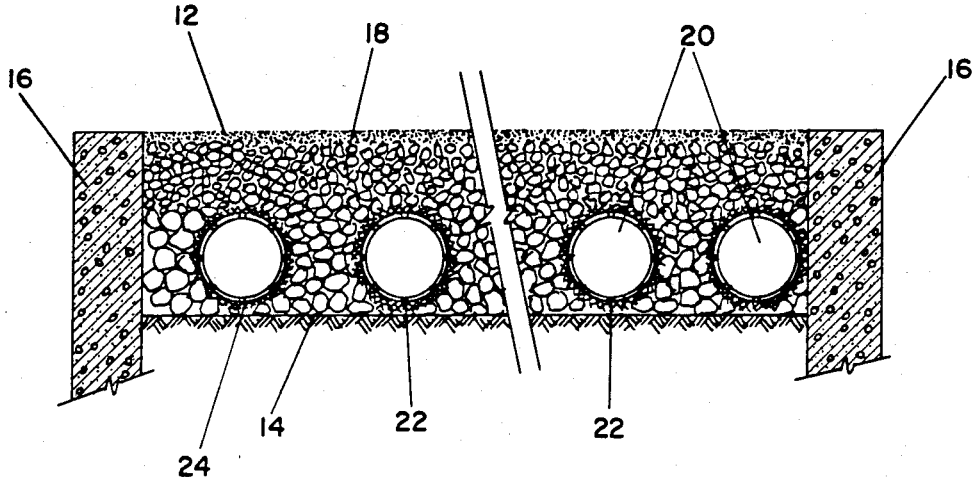
FIG. 4 is a side view of the FIG. 2 embodiment showing screening around each pipe.
Figure 5:
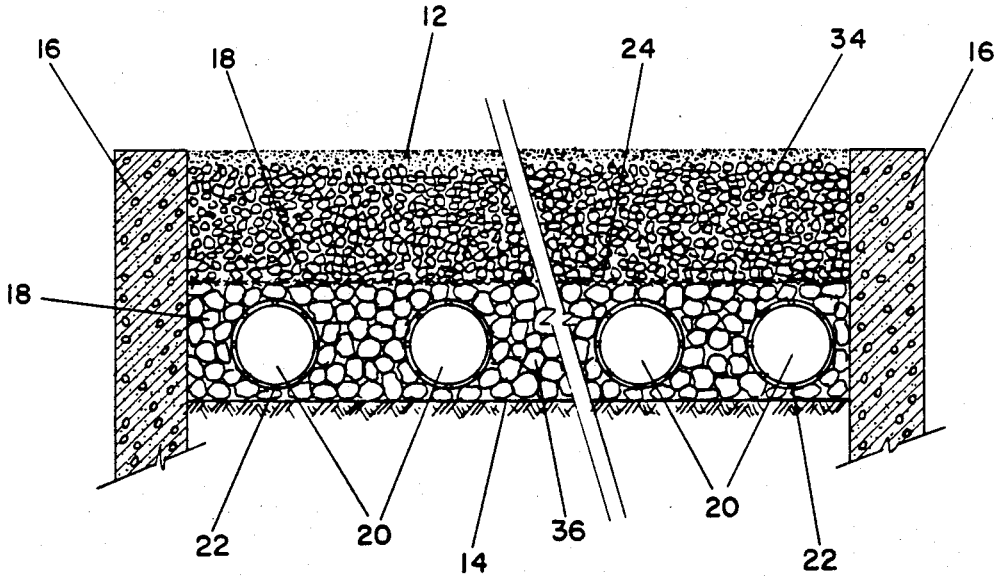
FIG. 5 is a side view of another embodiment of the invention showing screening disposed above the pipes.
Figure 7:
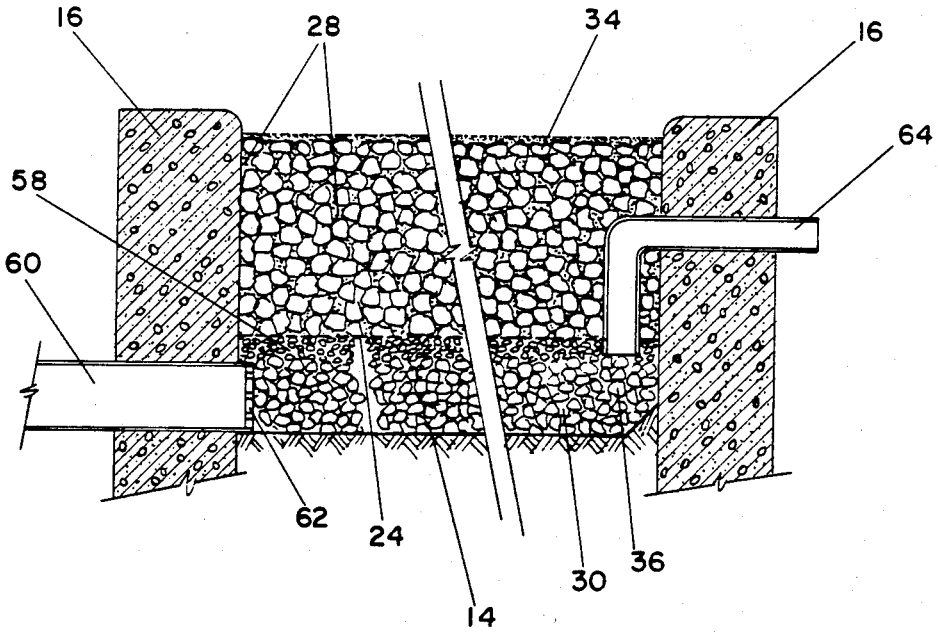
FIG. 7 is a side view of an alternative embodiment of the invention.

To prevent the aggregate material 18 from entering the pipes 20 through apertures 22, a layer of screening 24 may be provided. Screening 24 can be positioned as a layer within the subsurface bed of aggregate material 18 is shown in FIGS. 1, 5 and 7. In this embodiment, the aggregate material 18 surrounding the pipes should be of a size which is larger than the aperture size to deter the aggregate material 18 from entering the apertures 22. Alternatively, screening 24 can be wrapped around the pipes 20, as shown in FIGS. 2 and 4. In this embodiment, the screen size should be smaller than the aggregate material 18 surrounding the pipes.

The containment wall 16 of the invention shown in the drawing is positioned peripherally about the built-up court surface layer 12 and the barrier surface 14 spaced therebelow. Wall 16 extends upwardly from the barrier surface 14 to about the level of the built-up court surface layer 12. The preferred height of the containment wall is 4 inches to 6 inches, but it can be any desired height.

Figure 3:
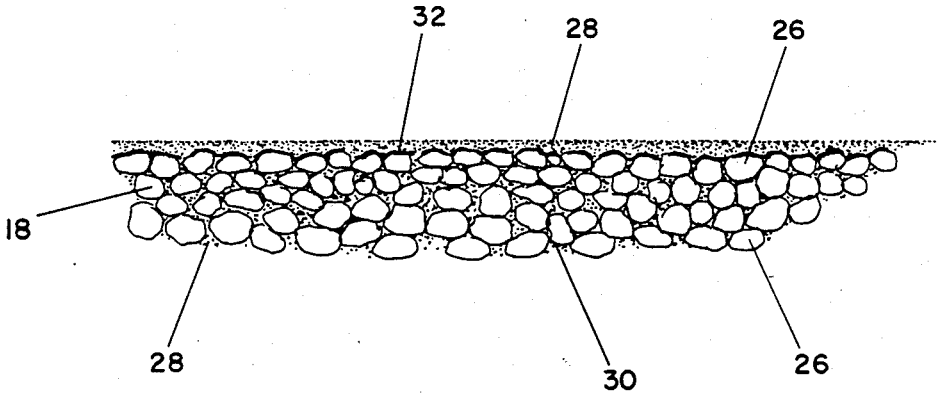
FIG. 3 is an enlarged side view of the upper portion of the built-up court structure of the invention showing stabilizing material.

An enlarged view of the subsurface bed of aggregate material 18 and the built-up court source layer 12 is shown in FIG. 3. As seen therein, a somewhat coarse aggregate material 26, such as common gravel, is used with a fine aggregate material 28, such as coarse common builders sand, fine clay or brick dust, fills void spaces 30 between pieces of the coarse aggregate material 26. Material 28 is also preferably used to form the built-up court surface layer 12. The preferred average cross-sectional width of the coarse aggregate 26 is between approximately 0.5 and 1 inch. The preferred average cross-sectional width of grains of the fine aggregate 28 is between approximately 0.005 and 0.025 inch. Fine clay or brick powder are of low permeability and could cause drainage problems if used without mixing them with the common builders sand.

To stabilize the built-up court surface layer 12 by preventing the aggregate materials from shifting, to thereby eliminate extensive maintenance, such as rolling, an adhesive material 32, such as polyurethane, epoxy or rubberized asphalt, is preferably sprayed atop the bed of coarse aggregate 26, as shown in FIG. 3. Only the tops of the pieces of this upper coarse aggregate layer 26 are coated to provide passages for liquid flow between the surface layer 12 and the subsurface bed. The adhesive material 32 is selected to remain resilient after curing. In an alternative embodiment, a low-strength, high-permeability mortar, such as a mixture of Portland cement, sand and water is utilized in conjunction with the adhesive material 32 to lock or stabilize the coarse aggregate 26. A preferred mixture is 1 part of Portland cement and 12 parts of coarse sand (0.005 to 0.025 inch grain size). The voids 30 in the layer 32 provide for good liquid conductivity therethrough.

After the coarse aggregate material 26 is stabilized, as discussed above, the fine aggregate material 28 is applied to the surface and washed down into the bed to fill the voids 30 between the coarse aggregate material 26 and to form the upper surface layer 12. The presence of the fine aggregate material 28 in the surface layer 12 and in the voids 30 of the subsurface bed of aggregate 18 keeps the court structure 10 permeable so that liquid can be drained from or added to the court structure 10. The smoothness of the top surface can then be easily established and maintained with conventional wide drag brooms.

Note in FIGS. 2 and 4 that the subsurface bed of aggregate material 18 comprises essentially the same size material. FIGS. 1, 5 and 7 illustrate embodiments with two layers, an upper layer of smaller aggregate material 34 and lower layer of larger aggregate material 36. For example, the upper layer of aggregate material 34 could be gravel having about a 0.5 inch average width and the lower layer of aggregate material 36 could be grave having a about 0.75 inch average width. When two layers 34 and 36 of coarse aggregate material ar used and screening 24 is present between the two layers 34 and 36, as shown in FIGS. 1, 5 and 7, fine aggregate material 28, such as sand, should not be present in the voids 30 of the lower layer of aggregate material 36, as the fine aggregate material 28 could enter the apertures 22 of the pipes 20. A layer of rock chips or pea gravel 58, (See FIG. 7) preferably having an average width of between approximately ⅛ inch and ¼ inch, may be utilized to help support the screening 24. This particle size provides a faster moisturizing rate via wicking than the larger gravel, and a slower rate than the sand. As stated previously, no drain pipes are used in FIG. 7 as adequate lateral drainage is possible through the spaces between the gravel.

Figure 6:
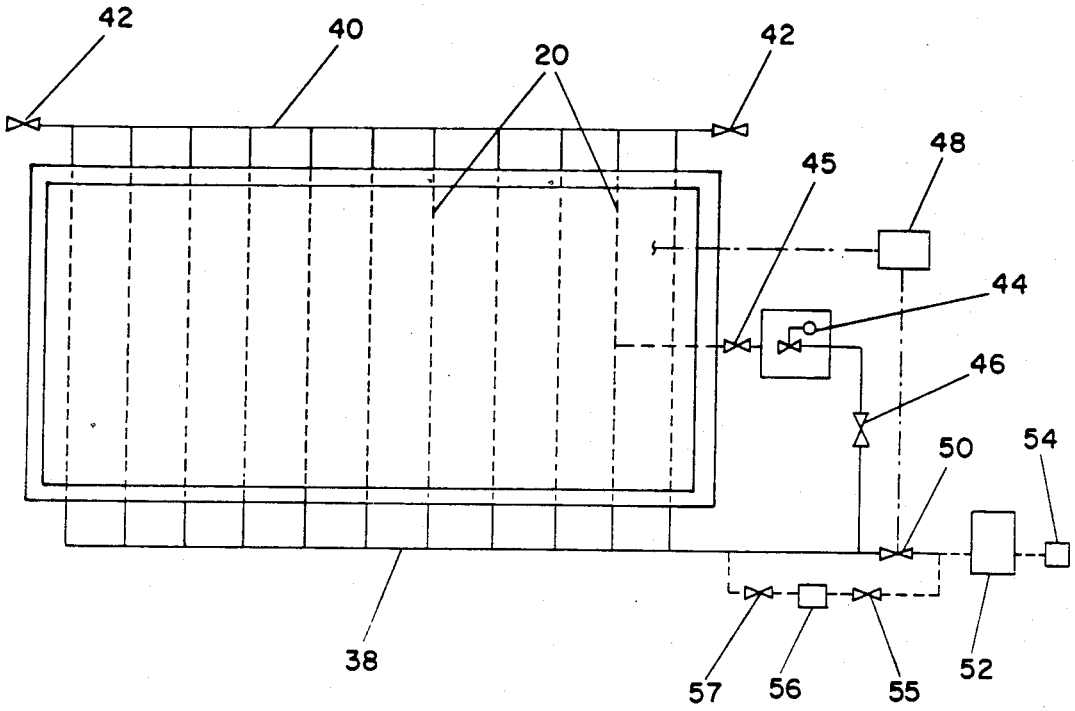
FIG. 6 schematically illustrates alternative control mechanisms for introducing liquid to and draining liquid from the playing court structure of the invention.

The FIG. 6 schematic illustrates a system for controlling the moisture content in the built-up court structure of the invention. The particular means used for achieving moisture and drainage control will depend o the climatic characteristics of the geographical location of the playing court, e.g., desert, or tropics, and the seasons, e.g., heavy rainfall, no rainfall, or high winds. The pipes 20 are shown in a substantially parallel configuration across the court. A pipe header 38 for filling the pipes 20 and another pipe header 40 for draining the pipes 20 are connected thereto. Conventional drain valves 42 can be provided on one or both ends of the drain pipe header 40 and the fill pipe header 38 (not shown). If the pipes 20 are sloped, they will slope downward toward the drain pipe header 40 so that gravity aids drainage. The pipe headers 38 and 40 may be disposed within the containment walls 16, but are preferably positioned outside the containment wall 16 so that accessing valves 42 will not require an access hole in the court surface. In one embodiment, a conventional float valve device 44, which comprises a float disposed in a liquid containing tank. The liquid level therein is maintained through this float valve. A line via valve 45 connects from this tank to pipes 20 at approximately the same level as the liquid level in the pipes 20 in the subsurface bed of aggregate 18. When the liquid level in the subsurface bed 18 drops, the level in the tank drops the same amount. The float causes valve 44 to open, replenishing water to the tank and to the subsurface bed 18, When the preset level is reached, valve 44 closes. Valves 45 and 46 are operated manually; in open position when valve 44 is in use, and closed when by-passed. In an alternative embodiment, shown by the dashed lines in FIG. 6, a moisture sensing instrument 48, is set to a desired moisture content. When moisturizing is needed, it causes a valve 50 to open, thereby allowing liquid present in a storage tank 52 to flow into the fill pipe header 38. The moisture sensor 48 may be positioned to detect moisture content at the pipe level or at the surface level. A water pump 54 or water pressure inducing device may be utilized to aid in filling the pipes 20. Additionally, valve 50 can be closed and liquids shunted through valve 55 and 57 through a choke, orifice or flow controller 56 to control the rate of flow of the liquid into the fill pipe header 38. Those skilled in the art will appreciate that the above described instruments may be controlled manually or automatically, as desired.

The above-described system has two modes, a draining mode and a moisturizing mode. The draining mode is used prior to or during rain or freezing weather. During the draining mode, liquid will flow through the aggregate materials, enter the pipe apertures 22, flow through the pipes 20, out the drain pipe header 40, and out drain valves 42. With the present invention, water drains through the surface, aggregate beds and pipes as fast as rain falls, thereby deterring lateral runoff from and erosion of the surface layer 12. The moisturizing mode is typically used in dry or windy weather conditions and any other time surface moisture evaporation is taking place. Various ways of controllably introducing liquid into the fill pipe header 38 were discussed above. Liquid from the fill pipe header 38 flows through the pipes 20, out of the apertures 22 and into the aggregate materials 18 to the preset level within the bed, then wicks by capillary action upward to the built-up court surface layer 12. The moisture barrier 14 prevents the liquid from flowing further downward out of the bed and also prevents settling or other movement of the foundation or base by retaining liquid from seeping out of the bed. As stated above, various types of liquids or additives may be used in the moisturizing mode to achieve desired results, such as killing vegetation, preventing freezing or merely to save on operating costs e.g., utilizing less expensive, non-potable water. Either or both modes can be used during play.

FIG. 7 illustrates an alternative embodiment of the invention. This embodiment does not use parallel pipes 20 as discussed above, but provides fill-drain pipes 60 for both providing liquid to and draining liquid from the built-up court structure 10. When additional moisture is required, liquid flows from the fill-drain pipes 60 into the subsurface bed of aggregate 18 to the preset level, and wicks therefrom upward to the built-up court surface layer 12. When drainage is required, liquid flows downward into the gravel bed and laterally outward into the fill-drain pipes 60. A coarse screen 62 is preferably provided over the open ends of the fill-drain pipes 60 to prevent the coarse aggregate material 36 from entering the fill-drain pipes 60. If a float-valve mechanism is utilized (not shown), the liquid level in the built up bed will be the same as the level in the float valve tank. Overflow pipes 64 can be used above the liquid level but below the surface for draining during rain, without the need to open valves on pipes 60. With this arrangement the system is an automatic draining and moisturizing mode at all times.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A built-up, moisture content controlling playing court structure comprising:

a built-up court surface layer comprising fine aggregate material;

a barrier surface substantially impervious to moisture spaced beneath said built-up court surface layer;

a containment wall positioned essentially peripherally about said built-up court surface layer and said barrier surface and extending upwardly from said barrier surface to about the level of said built-up court surface layer disposed thereabove;

a subsurface bed of aggregate disposed atop said barrier surface and beneath said built-up court surface layer, said subsurface bed of aggregate being peripherally surrounded by said containment wall;

a stabilizing layer of adhesive material applied atop said subsurface bed of aggregate, said stabilizing layer providing supportive stability to said subsurface bed of aggregate, said layer of adhesive material comprising voids therein to provide adequate liquid conductivity between said subsurface bed of aggregate and said built-up court surface layer thereabove to substantially maintain the selected moisture content in said built-up court surface layer, said built-up court surface layer of fine aggregate material disposed atop and in said voids of said adhesive coated stabilizing layer; and means for controllably introducing liquid to and draining liquid from said subsurface bed of aggregate and said built-up court surface layer to substantially maintain a selected moisture content in said built-up court surface layer.

2. The invention of claim 1 wherein said subsurface bed of aggregate comprises materials of at least two distinct size ranges to provide both adequate support for said built-up court surface layer and sufficient liquid conductivity for substantially maintaining the selected moisture content in said built-up court surface layer by introducing subsurface liquid to maintain moisture at the surface through capillary action, when appropriate, and by allowing gravity induced subsurface drainage, when appropriate.

3. The invention of claim 2 wherein said subsurface bed of aggregate comprises sand and gravel.

4. The invention of claim 3 wherein said sand comprises common builders sand having a size of between approximately 0.005 and about 0.025 inch in average cross-sectional width.

5. The invention of claim 3 wherein said gravel comprises common gravel having an average cross-sectional width of between approximately 0.5 and about 1 inch.

6. The invention of claim 1 wherein said built-up court surface layer comprises at least one material selected from the group consisting of common builders sand, fine-grain clay, and brick dust, or a mixture of these.

7. The invention of claim 1 wherein said built-up court surface layer is essentially horizontal.

8. The invention of claim 1 wherein said adhesive material is essentially moisture impervious.

9. The invention of claim 1 wherein said adhesive material comprises at least one member selected from the group consisting of polyurethane, expoxy and rubberized asphalt.

10. The invention of claim 1 wherein said barrier surface comprises plastic sheeting.

11. The invention of claim 1 wherein said containment wall is between approximately 4 inches and 6 inches in height.

12. The invention of claim 1 wherein the liquid to be introduced to said subsurface bed of aggregate and said built-up court surface comprises water with at least one additive selected from the group consisting of antifreeze, herbicide, surfactant, wetting agent and detergent.

13. The invention of claim 1 wherein said means for introducing liquid to and draining liquid from said subsurface bed of aggregate and said built-up court surface layer comprises a plurality of generally horizontal pipes disposed above said barrier surface, said pipes comprising apertures for introducing liquid to and draining liquid from said subsurface bed of aggregate and said built-up court surface layer.

14. The invention of claim 13 further comprising means for controlling liquid flow into, and drainage from, and thereby fluid level within said pipes and within said subsurface bed, to substantially maintain the selected moisture content of said built-up surface layer.

15. The invention of claim 14 wherein said fluid-controlling means comprises a float valve.

16. The invention of claim 14 wherein said fluid-controlling means comprises a moisture sensor.

17. The invention of claim 13 wherein said pipe apertures are covered with screening to deter aggregate material from entering said pipes.

18. The invention of claim 13 wherein said pipes are disposed at an angle to the horizontal sufficient to provide satisfactory liquid flow therethrough due to the force of gravity.

19. The invention of claim 13 wherein said pipes are disposed within said subsurface bed of aggregate having an average size which is larger than said apertures and a layer of screening is disposed above said subsurface bed of aggregate to deter aggregate material from entering said pipes.

20. The invention of claim 19 further comprising a second subsurface bed of aggregate disposed above said screening, said second subsurface bed of aggregate having an average size which is smaller than the size of said subsurface bed of aggregate disposed beneath said screening.

21. The invention of claim 1 wherein said means for introducing liquid to and draining liquid from said subsurface bed of aggregate and said built-up court surface layer comprises at least one fill-drain pipe having an opening in said subsurface bed of aggregate.

22. The invention of claim 21 wherein said opening of said fill-drain pipe is covered with screening to deter aggregate material from entering said fill-drain pipe.

23. A method of constructing a built-up, moisture content controlling playing court structure comprising the following steps:

(a) obtaining a foundation for the playing court structure;

(b) providing a moisture barrier above the foundation;

(c) providing a containment wall peripherally about the foundation;

(d) positioning above said moisture barrier means for introducing liquid to and draining liquid from said playing court structure to substantially maintain a selected moisture content in playing court structure;

(e) providing a subsurface bed of coarse aggregate above the moisture barrier;

(f) introducing fine aggregate into the voids of the coarse aggregate and onto its surface to provide a built-up, moisture content controlling playing court structure;

(g) applying an adhesive material incompletely across the top of the subsurface bed of aggregate to add stability to the subsurface bed of aggregate; and (h) disposing fine aggregate material atop and in the voids of the adhesive coated aggregate to provide a surface layer for the built-up playing court structure.

24. The method of claim 23 wherein the foundation provided is a hard-surface playing court.

25. The method of claim 23 wherein the foundation provided is compacted dirt.

26. The method of claim 23 wherein the means provided for introducing liquid to and draining liquid from the playing court structure comprises at least one pipe.

27. The method of claim 26 further comprising providing means for controlling liquid flow into and liquid drainage from the pipe to substantially maintain the selected moisture content of the playing court structure.

* * * * *